US007219960B1

(12) United States Patent
Hajianpour

(10) Patent No.: US 7,219,960 B1
(45) Date of Patent: May 22, 2007

(54) LIFTING CHAIR WITH MOVING ARMS

(76) Inventor: Mohammed A. Hajianpour, 1706 Vestal Dr., Coral Springs, FL (US) 33071

( * ) Notice: Subject to any disclaimer, the term of this patent is extended or adjusted under 35 U.S.C. 154(b) by 0 days.

(21) Appl. No.: 09/330,775

(22) Filed: Jun. 11, 1999

Related U.S. Application Data

(60) Provisional application No. 60/089,020, filed on Jun. 12, 1998.

(51) Int. Cl.
*A47C 1/12* (2006.01)

(52) U.S. Cl. ..... 297/313; 297/330; 297/331; 297/339

(58) Field of Classification Search ..... 297/313, 297/338, 339, 330, 411.24, 411.36
See application file for complete search history.

(56) References Cited

U.S. PATENT DOCUMENTS 4,838,612 A * 6/1989 Cross ..... 297/338 X
4,929,022 A 5/1990 Geraci ..... 297/313
4,979,726 A * 12/1990 Geraci ..... 297/313 X
5,094,508 A * 3/1992 Bathrick et al. ..... 297/320
6,113,188 A * 9/2000 Stewart et al. ..... 297/339 X

* cited by examiner

*Primary Examiner*—Anthony D. Barfield
(74) *Attorney, Agent, or Firm*—Ronald V. Davidge

(57) ABSTRACT

A lifting chair, having a seat which is pivoted upward, being hinged along its front edge to help lift an individual who has trouble rising from an ordinary chair, also has arms which move upward during this pivoting process. Similarly, the seat and arms are moved downward to help the individual sit down. The linkage preferably is a parallelogram type preventing rotation of the arms as they are moved upward and downward along arcuate paths.

11 Claims, 1 Drawing Sheet

LIFTING CHAIR WITH MOVING ARMS

This application claims benefit of a prior-filed provisional application, Ser. No. 60/089,020, filed Jun. 12, 1998.

BACKGROUND OF THE INVENTION

1 Field of the Invention

The present invention relates to a chair for use by a physically impaired person, and, more particularly, to a chair including mechanical means assisting a physically impaired person in sitting down and in rising.

2 Background Art

A number of types of chair mechanisms have been made for helping physically impaired people in sitting down and in rising. Such mechanisms generally include a seat portion which is pivoted along its front edge so that it is raised to aid the user in getting up and lowered to aid him in sitting down. The seat portion may be motor driven, or manually moved with a spring aiding the upward motion. This mechanism may be incorporated within a chair extending to the floor or within a seat configured for placement on a chair or bench. With mechanisms of this type, only the chair seat moves. The adjacent arms, if there are any, remain stationary. What is needed is a method for raising and lowering the chair arms with the seat, so that the user can be provided with a source of support and stability as he rises and sits down. U.S. Pat. No. 4,929,022 describes a chair having a lift apparatus including a seat pivoted along its front edge, a foot pedal extending near the floor along the front of the chair, and a handle extending in front of each arm. A person sitting in the chair and wishing to rise transfers his weight to his feet, depressing the foot pedal, and simultaneously pulls back on the handles to cause the rear of the seat to pivot upward. Again, what is needed is a method for raising the arms of the chair as the user is rising and for lowering the arms of the chair as he is sitting down.

SUMMARY OF THE INVENTION

In accordance with a first aspect of the present invention, there is provided a lifting chair including a stationary frame, a seat movable upward and downward relative to the stationary frame in a predetermined manner, drive means for moving the seat in the predetermined manner, a first arm disposed adjacent a first side of the seat, and a first linkage extending between the seat and the first arm, wherein the first linkage moves the first arm upward as the seat is moved upward, and downward as the seat is moved downward.

DETAILED DESCRIPTION OF THE INVENTION

Figure 1:
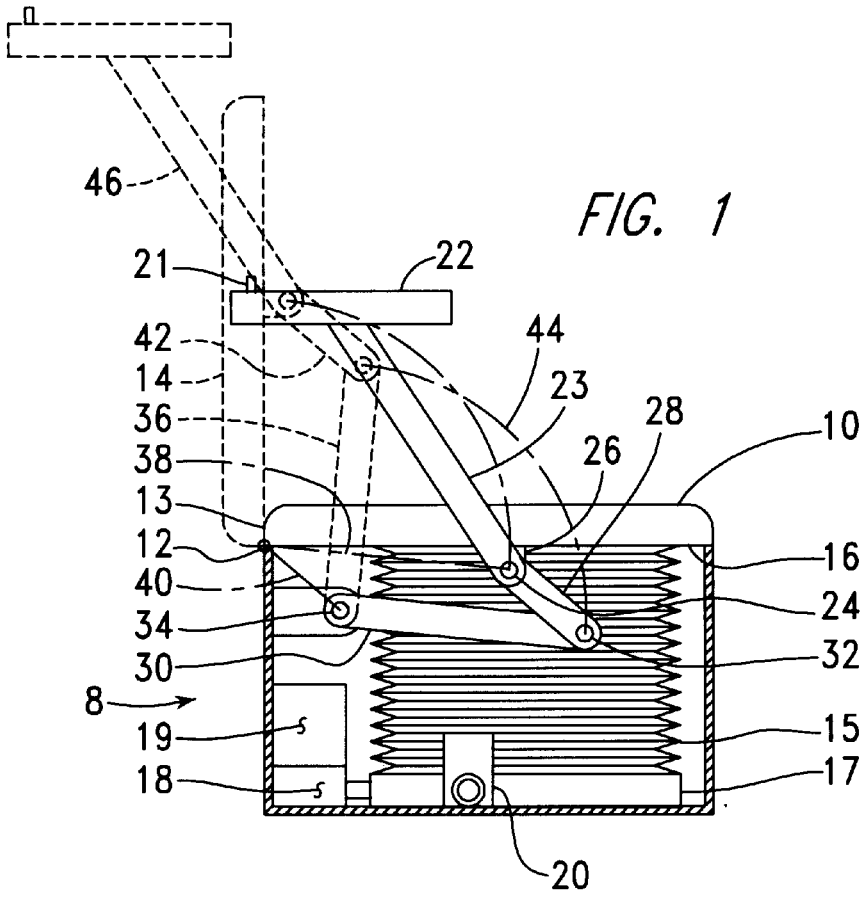
FIG. 1 is a partially sectional side elevation of a lifting chair built in accordance with a first embodiment of the present invention, showing the mechanism tying the movement of the arms to the movement of the seat.

FIG. 1 is a partially section side elevation of a lifting chair 8, including a seat 10, which is pivoted at a hinge axis 12 extending along its front edge 13, being raised through an angle of approximately 90 degrees into the position indicated by dashed lines 14. The seat is preferably lifted by a powered mechanism. For example, the seat may be lifted by a pneumatic bellows 15 or bag extending between the lower surface 16 of the seat 10 and a stationary plenum 17, through which air is introduced into the bellows 15 by a pump 18 driven by a motor 19. The seat is subsequently lowered by exhausting the air pumped into the bellows 15 through a solenoid valve 20. The processes of pumping air into the bellows 15 and of exhausting air through the solenoid valve 20 are preferably performed in response to the operation of a switch mechanism 21 on a chair arm 22.

The seat 10 may alternately be lifted by a pneumatic cylinder or by a mechanism including a motor driving a cam. Potential energy absorbed by the chair when a person sits down may be stored in a pneumatic or spring device to aid subsequently in the process of getting up.

This apparatus includes a chair arm 22 on each side of the seat 10. Each chair arm 22 is connected to the seat 10 by means of an arm support member 23 extending outside the seat 10. The arm support members 23 are each attached to a pivot rod 24, which is pivotally mounted in a pair of bearing blocks 26 to extend under the seat 10. The bearing blocks 26 are attached to the lower surface 18 of the seat 10. Also on each side of the seat 10, a crank 28 is attached to the pivot rod 24 to turn therewith. Each crank 28 is pivotally attached to a stabilizing arm 30 by means of a pivot pin 32. Each stabilizing arm 30 is pivotally mounted at a stationary pivot pin 34.

As the seat 10 is pivoted upward into the position indicated by dashed lines 16, the stabilizing arms 30 are pulled upward into the position indicated by dashed lines 36 by the cranks 28. The angular position of the cranks 28 is controlled by their pivotal connection to the stabilizing arms 30. Preferably, the apparatus is configured so that, when the seat 10 is in its lowered position, each stabilizing arm 30 extends, between pivot points 34, 32, parallel to a line 38 between the hinge pivot 12 and the pivot rod 24, and so that each crank 28 extends, between pivot rod 24 and the pivot point 32, in a direction parallel to a line 40 between the hinge pivot 12 and the pivot point 34. Thus, the hinge pivot 12, the pivot rod 24 and the pivot points 32, 24 are arranged as the vertices of a parallelogram. This parallogramatic relationship is retained as the seat is rotated upward into the position indicated by dashed lines 16. Thus, each crank 28 retains its angular orientation as it is moved into the position indicated by dashed lines 42. Since the arm support members 23 are connected to the cranks 28 through the pivot rod 24, the arm support members 23 and the chair arms 22 attached thereto translate upward along an arcuate path 44 without rotation. That is, the arm support members 23 and the arms 22 move upward, without tilting, into the position indicated by dashed lines 46. As the seat 10 is moved back down, the arms 22 move in the same way, but in the opposite direction, providing support for a person being lowered into the chair.

This apparatus may be used as part of a chair or as part of a portable device to be placed on a chair or other seat. In the latter application, the height of the mechanism is significant, since it is desirable to make the device as thin as possible, minimizing the vertical distance between the seat and the surface on which the device is placed.

Figure 2:
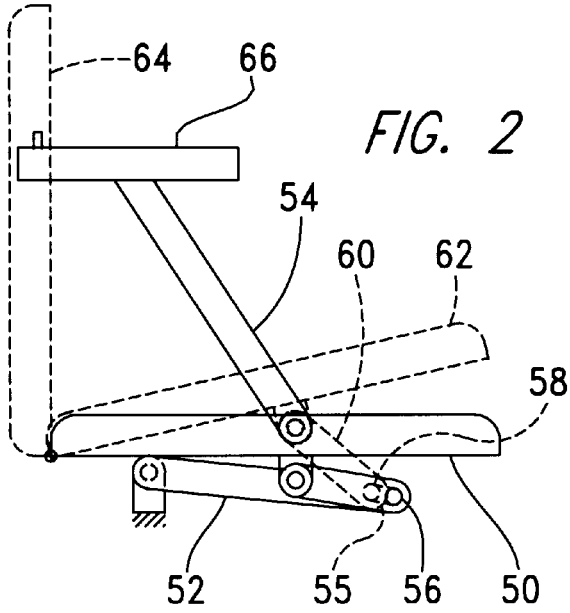
FIG. 2 a side elevation of the mechanism tying the movement of the arms to the movement of the seat in a second embodiment of the invention.

FIG. 2 is a side elevation of a version of the apparatus with which this distance is minimized. In this apparatus, when the seat 50 is in its lowered position, the angular relationship between each stabilizing arm 52 and the associated crank 54 is too small to allow the initial movement of the crank 54 to start the movement of the stabilizing arm 52. However, a slot 55 is provided in the stabilizing arm 52, so that the pivot pin 56 extending between the stabilizing arm 52 and the crank 54 slides into the position indicated by dashed lines 58, with the crank 54 being moved into the position indicated by dashed lines 60 as the seat 50 is initially raised into the position indicated by dashed lines 62. Following this initial movement, the apparatus operates generally as described above in reference to FIG. 1, as the seat 50 is raised into the position indicated by dashed lines 64.

While the invention has been described in its preferred form or embodiment with some degree of particularity, it is understood that this description has been given only by way of example, and that numerous changes in the details of construction, fabrication, and use may be made without departing from the spirit and scope of the invention.

I claim:

1. A lifting chair including:

a stationary frame;

a seat movable upward and downward relative to said stationary frame in a predetermined manner;

drive means for moving said seat in said predetermined manner;

a first chair arm member disposed adjacent a first side of said seat, and a first pivoting linkage extending between said seat and said first chair arm member, wherein said first pivoting linkage moves said first chair arm member upward as said seat is moved upward, and downward as said seat is moved downward.

2. The lifting chair of claim 1, wherein said seat is pivotally mounted on said stationary frame along a first pivot axis extending along a front edge of said seat; and said first pivoting linkage includes an arm support member extending downward from said first chair arm member, pivotally mounted at a second pivot axis on said seat, a crank mounted to pivot and move with said arm support member, and a stabilizing arm, pivotally mounted on said crank at a third pivot axis and pivotally mounted on said stationary frame at a fourth pivot axis.

3. The lifting chair of claim 2, wherein said first, second, third, and fourth pivot axes are configured to form a parallelogram, a line between said first and second pivot axes extends parallel to a line between said fourth and third pivot axes, and a line between said first and fourth pivot axes extends parallel to a line between said second and third pivot axes.

4. The lifting chair of claim 2, wherein said crank is additionally mounted to slide relative to said arm support member as said seat is pivoted through a predetermined angle.

5. The lifting chair of claim 2, wherein said lifting chair additionally includes a second chair arm member disposed adjacent a second side of said seat, opposite said first side of said seat, and a second pivoting linkage extending between said seat and said first chair arm member, wherein said second pivoting linkage moves said second chair arm member upward as said seat is moved upward, and downward as said seat is moved downward.

6. The lifting chair of claim 5, wherein said seat is pivotally mounted on said stationary frame along a first pivot axis extending alone a front edge of said seat, said first pivoting linkage includes an arm support member extending downward from said first chair arm member, pivotally mounted at a second pivot axis on said seat, a crank mounted to pivot and move with said arm support member, and a stabilizing arm, pivotally mounted on said crank at a third pivot axis and pivotally mounted on said stationary frame at a fourth pivot axis, and said second pivoting linkage includes an arm support member extending downward from said second chair arm member, pivotally mounted at said second pivot axis on said seat, a crank mounted to pivot and move with said arm support member, and a stabilizing arm, pivotally mounted on said crank at said third pivot axis and pivotally mounted on said stationary frame at said fourth pivot axis.

7. The lifting chair of claim 6, wherein said first, second, third, and fourth pivot axes are configured to form a parallelogram, a line between said first and second pivot axes extends parallel to a line between said fourth and third pivot axes, and a line between said first and fourth pivot axes extends parallel to a line between said second and third pivot axes.

8. The lifting chair of claim 1, wherein said drive means includes:

a flexible container, including an internal cavity, extending between a lower side of said seat and said stationary frame, a pump for forcing air into said internal cavity, a motor driving said pump, a solenoid valve exhausting air from said internal cavity, and a control switch on said first chair arm member, controlling operation of said motor and of said solenoid valve.

9. A linkage for moving a chair arm with a chair seat pivotally mounted on a stationary frame along a first pivot axis, wherein said linkage comprises:

an arm support member for attachment to extend downward from said chair arm;

first pivotal mounting means for pivotally mounting said arm support member at a second pivot axis on said seat;

a crank mounted to pivot and move with said arm support member;

a stabilizing arm pivotally mounted on said crank at a third pivot axis; and second pivotal mounting means for pivotally mounting said stabilizing arm on said stationary frame at a fourth pivot axis.

10. The linkage of claim 9, wherein said first, second, third, and fourth pivot axes are configured to form a parallelogram, a line between said first and second pivot axes extends parallel to a line between said fourth and third pivot axes, and a line between said first and fourth pivot axes extends parallel to a line between said second and third pivot axes.

11. The lifting chair of claim 10, wherein said crank is additionally mounted to slide relative to said arm support member as said seat is pivoted through a predetermined angle.

* * * * *